US006911174B2

(12) United States Patent
Creagan

(10) Patent No.: US 6,911,174 B2
(45) Date of Patent: Jun. 28, 2005

(54) PROCESS OF MAKING MULTICOMPONENT FIBER INCORPORATING THERMOPLASTIC AND THERMOSET POLYMERS

(75) Inventor: Christopher Cosgrove Creagan, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/331,708

(22) Filed: Dec. 30, 2002

(65) Prior Publication Data

US 2004/0126579 A1 Jul. 1, 2004

(51) Int. Cl.[7] ..... D01D 5/098; D01D 5/32; D01D 5/34; D01D 5/36; D04H 3/02

(52) U.S. Cl. ..... 264/444; 264/103; 264/172.13; 264/172.14; 264/172.15; 264/210.8; 264/474; 264/476; 264/477; 264/555

(58) Field of Search ..... 264/103, 172.13, 264/172.14, 172.15, 210.8, 444, 474, 476, 477, 555

(56) References Cited

U.S. PATENT DOCUMENTS

| | | | | |
|---|---|---|---|---|
| 3,692,618 | A | | 9/1972 | Dorschner et al. |
| 3,802,817 | A | | 4/1974 | Matsuki et al. |
| 3,849,241 | A | | 11/1974 | Butin et al. |
| 3,855,046 | A | | 12/1974 | Hansen et al. |
| 4,041,203 | A | | 8/1977 | Brock et al. |
| 4,340,563 | A | | 7/1982 | Appel et al. |
| 4,488,928 | A | | 12/1984 | Ali Khan et al. |
| 4,680,156 | A | | 7/1987 | Collier |
| 4,720,415 | A | | 1/1988 | Vander Wielen et al. |
| 4,789,699 | A | | 12/1988 | Kieffer et al. |
| 4,826,284 | A | | 5/1989 | Sakagami et al. |
| 4,981,747 | A | | 1/1991 | Morman |
| 5,094,717 | A | | 3/1992 | Manning et al. |
| 5,108,820 | A | | 4/1992 | Kaneko et al. |
| 5,246,772 | A | | 9/1993 | Manning |
| 5,292,459 | A | | 3/1994 | Gelissen et al. |
| 5,336,552 | A | | 8/1994 | Strack et al. |
| 5,352,518 | A | * | 10/1994 | Muramoto et al. ..... 428/373 |
| 5,382,400 | A | | 1/1995 | Pike et al. |
| 5,989,004 | A | | 11/1999 | Cook |
| 6,350,399 | B1 | | 2/2002 | Cook et al. |
| 6,368,533 | B1 | | 4/2002 | Morman |
| 6,461,133 | B1 | | 10/2002 | Lake et al. |
| 6,474,967 | B1 | | 11/2002 | Haynes et al. |

FOREIGN PATENT DOCUMENTS

| | | |
|---|---|---|
| EP | 0446377 A1 | 9/1991 |
| EP | 0480724 A1 | 4/1992 |
| WO | WO 97/02375 A1 | 1/1997 |
| WO | 00/34567 A2 | 6/2000 |
| WO | 01/41898 A1 | 6/2001 |

OTHER PUBLICATIONS

Japanese Abstract JP 54 055621 A, May 2, 1979, Nippon Synthetic Chem. Ind. Co.

* cited by examiner

*Primary Examiner*—Leo B. Tentoni
(74) *Attorney, Agent, or Firm*—Robert A. Ambrose

(57) ABSTRACT

The present invention provides a multicomponent fiber containing at least two polymer components arranged in distinct zones or segments across the cross-section of the fiber wherein at least one component of the fiber contains a thermoplastic polymer and at least one component of the fiber contains a thermoset polymer. The invention also provides fabrics and fabric laminates containing the multicomponent fibers, and articles containing the fabric. Additionally provided is a process for producing the multicomponent fibers.

10 Claims, 3 Drawing Sheets

PROCESS OF MAKING MULTICOMPONENT FIBER INCORPORATING THERMOPLASTIC AND THERMOSET POLYMERS

TECHNICAL FIELD

The present invention is related to multicomponent fibers having thermoset polymeric components and thermoplastic polymeric components, and to fabrics made from such multicomponent fibers.

BACKGROUND OF THE INVENTION

Many of the medical care garments and products, protective wear garments, mortuary and veterinary products, and personal care products in use today are partially or wholly constructed of nonwoven materials. Examples of such products include, but are not limited to, medical and health care products such as surgical drapes, gowns and bandages, protective workwear garments such as coveralls and lab coats, and infant, child and adult personal care absorbent products such as diapers, training pants, disposable swimwear, incontinence garments and pads, sanitary napkins, wipes and the like. For these applications nonwoven fibrous webs provide functional, tactile, comfort and aesthetic properties which can approach or even exceed those of traditional woven or knitted cloth materials. Nonwoven materials are also widely utilized as filtration media for both liquid and gas or air filtration applications since they can be formed into a lofty filter mesh of fibers having a low average pore size suitable for trapping particulate matter while still having a low pressure drop across the mesh.

Nonwoven materials are commonly produced from fibers made from thermoplastic polymers. Thermoplastic polymers are useful fiber-forming materials for several reasons. Thermoplastic polymers are readily spun into fibers by such processes well known to the art as staple fiber spinning, spunbonding and meltblowing, and fibers formed from thermoplastic polymers are readily bondable by simple methods such as heat and pressure. Also, certain thermoplastic polymers are elastomers and when formed into fibers produce fibers having properties of stretch and recovery. Additionally, fabrics made from thermoplastic fibers may be bonded and/or thermoformed into shaped articles by the selective application of heat and pressure. However, fibers formed from thermoplastic polymers, and the materials and fabrics formed therefrom, are also subject to damage from excessive heat such as deformation of the nonwoven fabric and may even melt or burn when exposed to heat. Thermoplastic polymers in many cases lack chemical resistance and so may degrade or dissolve in the presence of chemicals.

Thermoset polymers, on the other hand, generally have superior resistance to both chemical degradation and to melting or deforming upon heat exposure. In addition, thermoset polymers when formed into fibers have superior strength, toughness and resilience compared to thermoplastic fibers, and elastic thermoset polymers offer superior stretch and recovery properties compared to thermoplastic elastomers. However, fibers formed from thermoset polymers usually are not bondable by the simple expedient of heat bonding, such as by calender bonding with heat and pressure or through-air bonding with heated air, and a nonwoven web or fabric made entirely from thermoset polymer fibers would therefore require additional bonding media such as adhesives.

Consequently, there remains a need for fibers which have a high level of resilience, strength and toughness and/or high elastic properties, yet are able to be bonded into nonwoven fabrics without the need of additional bonding media such as adhesives. Additionally, there remains a need for a fiber production process for such advantageous fibers which is continuous and can be used in large commercial scale productions.

By varying the types and properties of the thermoset and thermoplastic polymers a nonwoven web can be engineered to maintain certain desired attributes such as thermal bondability while improving various properties such as flame resistance, elasticity, strength, durability, pressure drop and compression-resistant and resilient bulk or loft.

SUMMARY OF THE INVENTION

The present invention provides multicomponent fibers containing at least first and second polymer components which are arranged in distinct segments across the cross-section of the fiber along the length of the fiber, wherein the first polymer component is a thermoplastic polymer and the second polymer component is a thermoset polymer. The thermoplastic polymer component may be a polyolefin, polyamide or polyester, or may be a blend of various polyolefins, polyamides or polyesters. The thermoset polymer component may a thermoset urethane polymer, silicone polymer, phenolic polymer, amino polymer, or epoxy polymer. The multicomponent fibers may be elastic or inelastic, and may be flame retardant. The invention additionally provides nonwoven fabrics from the multicomponent fiber and useful articles comprising the nonwoven fabrics.

In one embodiment, the components of the multicomponent fiber have a geometric arrangement within the fiber such that only one component of the multicomponent fiber occupies the entire outer surface of the fiber, such as the sheath-and-core and islands-in-the-sea arrangements as are known in the art. In certain other embodiments, the components of the multicomponent fiber have a geometric arrangement within the fiber such that each component of the multicomponent fiber occupies at least a portion of the outer surface of the fiber. Such geometric arrangements as are known in the art include side by side, pie wedge, hollow pie wedge and striped fiber arrangements.

The invention also provides a process for producing the multicomponent fibers. The process includes the steps of providing a thermosetting pre-polymer component and a thermoplastic polymer component and co-extruding the components as multicomponent fibers, attenuating the multicomponent fibers with a drawing force, and subjecting the multicomponent fibers to energy to cause the thermosetting pre-polymer component to crosslink. The multicomponent fibers may further be collected upon a moving surface as a nonwoven web or fabric.

DEFINITIONS

Figure 1A:
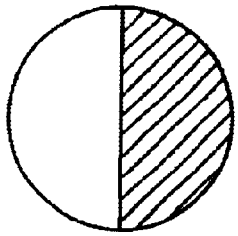
FIGS. 1A to 1G illustrate suitable multicomponent fiber configurations for the present invention.

As used herein and in the claims, the term "comprising" is inclusive or open-ended and does not exclude additional unrecited elements, compositional components, or method steps.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries.

As used herein the term "thermoplastic" or "thermoplastic polymer" refers to polymers which will soften and flow or melt when heat and pressure are applied, the changes being reversible As used herein the term "thermoset" or "thermoset polymer" refers to resins which change irreversibly under the influence of energy from a fusible and soluble material into one which is infusible and insoluble through the formation of a covalently crosslinked, thermally stable network. Thermoset polymers will not soften and flow when heat and pressure are applied.

As used herein the term "fibers" refers to both staple length fibers and substantially continuous filaments, unless otherwise indicated. As used herein the term "substantially continuous" with respect to a filament or fiber means a filament or fiber having a length much greater than its diameter, for example having a length to diameter ratio in excess of about 15,000 to 1, and desirably in excess of 50,000 to 1.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g. titanium dioxide for color, are conventionally present, if at all, in an amount less than 5 weight percent and more typically about 1–2 weight percent.

As used herein the term "multicomponent fibers" refers to fibers which have been formed from at least two component polymers, or the same polymer with different properties or additives, extruded from separate extruders but spun together to form one fiber. Multicomponent fibers are also sometimes referred to as conjugate fibers or bicomponent fibers, although more than two components may be used. The polymers are arranged in substantially constantly positioned distinct zones across the cross-section of the multicomponent fibers and extend continuously along the length of the multicomponent fibers. The configuration of such a multicomponent fiber may be, for example, a sheath/core arrangement wherein one polymer is surrounded by another, or may be a side by side arrangement, an "islands-in-the-sea" arrangement, or arranged as pie-wedge shapes or as stripes on a round, oval or rectangular cross-section fiber, or other. Multicomponent fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios. In addition, any given component of a multicomponent fiber may desirably comprise two or more polymers as a multiconstituent blend component.

As used herein the term "biconstituent fiber" or "multiconstituent fiber" refers to a fiber formed from at least two polymers, or the same polymer with different properties or additives, extruded from the same extruder as a blend. Multiconstituent fibers do not have the polymer components arranged in substantially constantly positioned distinct zones across the cross-section of the multicomponent fibers; the polymer components may form fibrils or protofibrils which start and end at random.

As used herein the term "nonwoven web" or "nonwoven fabric" means a web having a structure of individual fibers or filaments which are interlaid, but not in an identifiable manner as in a knitted or woven fabric. Nonwoven fabrics or webs have been formed from many processes such as for example, meltblowing processes, spunbonding processes, airlaying processes, and carded web processes. The basis weight of nonwoven fabrics is usually expressed in grams per square meter (gsm) or ounces of material per square yard (osy) and the fiber diameters useful are usually expressed in microns. (Note that to convert from osy to gsm, multiply osy by 33.91).

The term "spunbond" or "spunbond fiber nonwoven fabric" refers to a nonwoven fiber fabric of small diameter fibers that are formed by extruding molten thermoplastic polymer as fibers from a plurality of capillaries of a spinneret. The extruded fibers are cooled while being drawn by an eductive or other well known drawing mechanism. The drawn fibers are deposited or laid onto a forming surface in a generally random, isotropic manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al., U.S. Pat. No. 3,802,817 to Matsuki et al. and U.S. Pat. No. 3,692,618 to Dorschner et al. Typically, spunbond fibers have a weight-per-unit-length in excess of 2 denier and up to about 6 denier or higher, although finer spunbond fibers can be produced.

As used herein the term "meltblown fibers" means fibers formed by extruding a molten thermoplastic material through a plurality of fine, usually circular, die capillaries as molten threads or fibers into converging high velocity gas (e.g. air) streams which attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are generally smaller than 10 microns in diameter, and are generally tacky when deposited onto a collecting surface.

The term "staple fibers" refers to discontinuous fibers, which typically have an average diameter similar to that of spunbond fibers. Staple fibers may be produced with conventional fiber spinning processes and then cut to a staple length, typically from about 1 inch (2.54 cm) to about 8 inches (20.32 cm). Such staple fibers are subsequently carded or airlaid and thermally or adhesively bonded to form a nonwoven fabric.

As used herein "carded webs" refers to nonwoven webs formed by carding processes as are known to those skilled in the art and further described, for example, in coassigned U.S. Pat. No. 4,488,928 to Alikhan and Schmidt which is incorporated herein in its entirety by reference. Briefly, carding processes involve starting with staple fibers in a bulky batt that is combed or otherwise treated to provide a generally uniform basis weight. A carded web may then be bonded by conventional means as are known in the art such as for example through air bonding, ultrasonic bonding and thermal point bonding.

As used herein, "thermal point bonding" involves passing a fabric or web of fibers or other sheet layer material to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch (about 31 bonds/square cm) as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Other common patterns include a diamond pattern with repeating and slightly offset diamonds and a wire weave pattern looking as the name suggests, e.g. like a woven window screen. Typically, the percent bonding area varies from around 10% to around 30% of the area of the fabric laminate web. Thermal point bonding imparts integrity to individual layers by bonding fibers within the layer and/or for laminates, point bonding holds the layers together to form a cohesive laminate.

DETAILED DESCRIPTION OF THE INVENTION

The present invention provides multicomponent fibers and a method for producing the same. The invention additionally provides nonwoven webs or fabrics containing the multicomponent fibers and articles therefrom. The multicomponent fibers can be characterized in that each multicomponent fiber contains at least first and second polymer components which are arranged in distinct segments across the, cross-section of the fiber along the length of the fiber, wherein the first polymer component is a thermoplastic polymer and the second polymer component is a thermoset polymer.

The present multicomponent fiber is highly advantageous over fibers known in the art. Compared to prior art monocomponent or multicomponent fibers having all thermoplastic polymer components, the thermoset-thermoplastic multicomponent fibers can provide increased toughness, resiliency, elasticity, and/or resistance to chemical or thermal degradation. However, unlike prior art fibers made entirely of thermoset polymer, the thermoset-thermoplastic multicomponent fibers of the invention are suitable for heat bonding such as by smooth or patterned calender bonding or by through-air bonding methods as are known in the art.

Figure 1B:
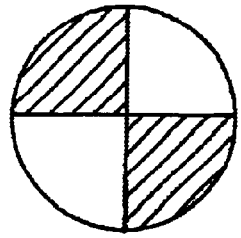
Figure 1C:
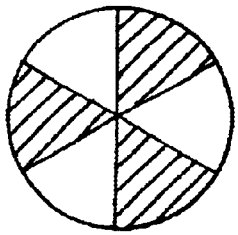
Figure 1D:
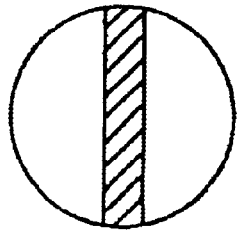

The thermoset-thermoplastic multicomponent fibers may have various cross-sectional configurations or geometric arrangements depending on the embodiment. In certain embodiments, the thermoset polymer component and the thermoplastic polymer component are both exposed on the outer or peripheral surface of the multicomponent fiber. Suitable configurations of this type include the side-by-side configurations such as in FIG. 1A, wedge configurations such as in FIG. 1B and FIG. 1C, and sectional or striped configurations such as in FIG. 1D. It should be noted that although these figures may depict multicomponent fiber configurations wherein individual components occupy approximately equal portions of the cross sectional area of the entire fiber, they need not be limited to such. For example, in the fiber depicted in FIG. 1B each of the two shaded and two non-shaded components occupies approximately 25 percent of the cross sectional area of the entire fiber; however, a multicomponent fiber wherein the two shaded components each occupy 35 percent, and each of the non-shaded components occupy 15 percent, of the cross sectional area of the fiber would also be suitable. Other variations in the distribution of the individual components of the multicomponent fiber are of course possible and will be evident to one of ordinary skill in the art, such as for example hollow wedge arrangements and rectangular or ribbon-shaped striped fibers.

Figure 1E:
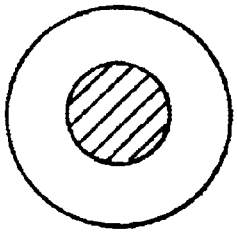
Figure 1F:
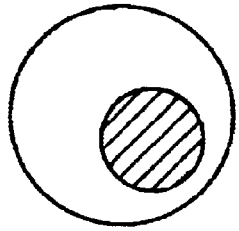
Figure 1G:
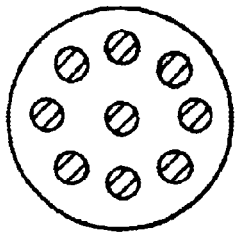

In other embodiments, only one of the thermoset polymer component and the thermoplastic polymer component is exposed on the outer or peripheral surface of the multicomponent fiber. Suitable configurations of this type include the sheath and core and eccentric sheath and core configurations shown in FIG. 1E and FIG. 1F, respectively, and the islands-in-the-sea configuration shown in FIG. 1G. Desirably, where only one polymer component is exposed on the outer or peripheral surface of the multicomponent fiber, the thermoplastic polymer component is the exposed component, so that for a sheath and core or islands-in-the-sea configuration, the sheath or sea component is a thermoplastic polymer and the core or island component is a thermoset polymer. As mentioned above, the configurations need not be limited to those having equal or approximately equal amounts of thermoset polymer and thermoplastic polymer. As an example, the sheath and core configuration shown in FIG. 1E may be configured such that more or less of the cross-sectional area of the multicomponent fiber comprises the sheath portion.

It should also be noted that the thermoset-thermoplastic multicomponent fibers of the invention may be crimped or uncrimped. Certain configurations such as the side-by-side and eccentric sheath and core configurations are suitable for the formation of helical crimps in the multicomponent fibers and, thus, for increasing the bulk or loft of the fabric produced from the fibers. In addition, methods of mechanical crimping as are known to those skilled in the art may be used to impart crimp.

Thermoplastic polymers suitable for the present invention include polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and a tactic polypropylene; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, poly-butylene terephthalate, polytetramethylene terephthalate, polycyclohexylene-1,4-dimethylene terephthalate, and isophthalate copolymers thereof, as well as blends thereof. Selection of polymers for the components of the multicomponent fibers is guided by end-use need, economics, and processability.

Thermoset polymers suitable for the present invention include any thermoset polymer which can be made from an energy activatable thermosetting pre-polymer composition. Examples of such polymers include polyurethanes such as urethane polyesters, silicone polymers, phenolic polymers, amino polymers, epoxy polymers, bismaleimides, polyimides, and furan polymers. Generally, the energy activatable thermosetting pre-polymer component will include at least one polymer precursor and a curing agent. The precursor(s) maybe heat activatable eliminating the need for a catalyst. The curing agent chosen will not only determine the type of energy source needed to form the thermoset polymer, but may also influence the resulting properties of the thermoset polymer. Examples of curing agents include aliphatic amines, aromatic amines, and acid anhydrides, besides other catalytic curing agents. The energy activatable thermosetting pre-polymer composition may include a solvent or processing aid to lower the viscosity of the composition for ease of extrusion including higher throughputs and lower temperatures. The solvent could help retard the crosslinking reaction and could partially or totally evaporate during or after fiber formation. Energy activatable thermosetting pre-polymer compositions are discussed in detail in U.S. Pat. No. 6,368,533 to Morman, which is incorporated herein by reference in its entirety.

It should be noted that the above listings of suitable thermoplastic polymers and suitable thermoset polymers are not exhaustive and other polymers known to one of ordinary skill in the art may be employed, so long as the particular combination of polymers selected to be the components of the multicomponent fiber are capable of being co-spun in a fiber extrusion process, which will depend on such factors as, for example, the relative viscosities of the thermoplastic melt and thermosetting pre-polymer composition. In addition, it should be noted that the polymers may desirably contain other additives such as processing aids, treatment compositions to impart desired properties to the multicomponent fibers, residual amounts of solvents, pigments or colorants and the like.

Processes suitable for producing the thermoplastic-thermoset multicomponent fibers of the present invention include textile filament production processes, staple fiber production processes, spunbond fiber production processes and meltblown fiber production processes. These multicomponent fiber production processes are known in the art. For example, U.S. Pat. No. 5,382,400 to Pike et al., incorporated herein by reference, discloses a suitable process for producing multicomponent fibers and webs thereof. As another example, U.S. Pat. No. 6,474,967 to Haynes et al. and U.S. Pat. No. 6,461,133 to Lake et al., both incorporated herein by reference, disclose processes for producing multicomponent meltblown fibers and webs thereof.

Figure 2:
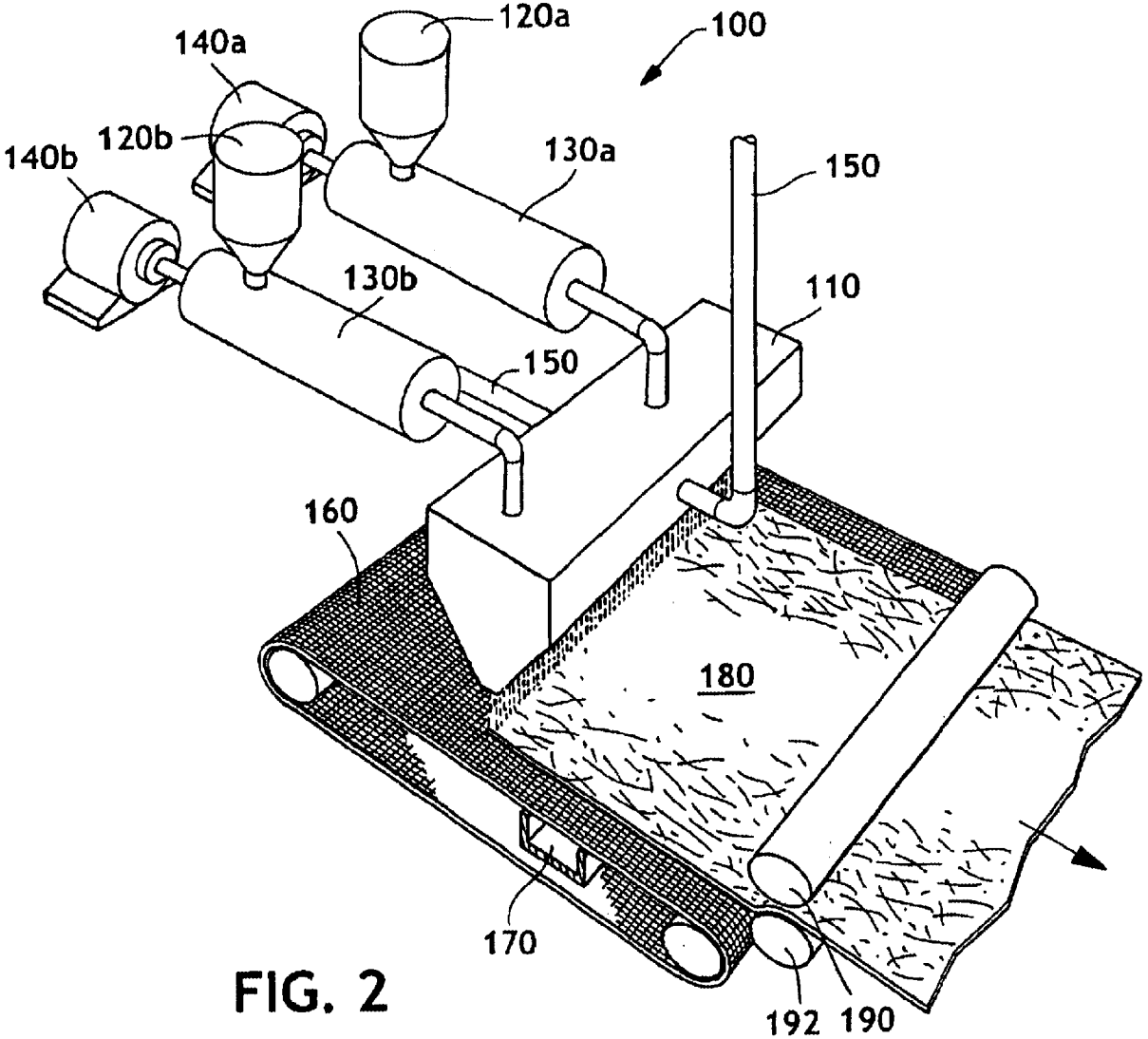
FIG. 2 is a schematic illustration of an exemplary process for producing the multicomponent fibers and multicomponent fiber fabrics of the present invention.

The thermoset-thermoplastic multicomponent fibers of the invention can be produced by fiber spinning processes such as spunbond-type fiber spinning or meltblowing. Turning to FIG. 2, the multicomponent fibers will be described with reference to the exemplary fiber spinning process depicted therein.

FIG. 2 illustrates an exemplary process for producing the thermoset-thermoplastic multicomponent fibers of the present invention, which process is based on a meltblowing-type process. As shown in FIG. 2, process line 100 comprises meltblowing die 110 suitable for forming multicomponent fibers, such as the meltblowing die disclosed in the afore-mentioned U.S. Pat. No. 6,474,967 to Haynes et al. Hopper 120*a* provides the energy activatable thermosetting pre-polymer composition to extruder 130*a*, which is driven by motor 140*a* to pump the energy activatable thermosetting pre-polymer composition to die 110. Alternatively, the thermosetting pre-polymer composition may be injected or pumped into the process line 100 just at the die 110 or at any point prior to extrusion at die 110 by other means known to the art as for example by use of a cavity transfer mixer (not shown). In that instance, extruder 120*a* may be omitted from process line 100.

Returning to FIG. 2, hopper 120*b* separately provides a thermoplastic polymer to extruder 130*b*, driven by motor 140*b*, to melt and pump the thermoplastic polymer to die 110. Conduits 150 provide a source of attenuating fluid to die 110 to draw out the fibers. The multicomponent fibers formed from die 110 are collected onto a foraminous forming surface 160 with the aid of a vacuum box 170 to form web 180 of thermoset-thermoplasitc multicomponent fibers. Thereafter, web 180 may be compacted or densified, or otherwise bonded by rolls 190, 192.

As a specific example, a fabric comprising fibers made accordance with the invention could be made using the multicomponent meltblown apparatus described in U.S. Pat. No. 6,474,967 to Haynes et al. The first component would consist of an energy-activatable thermosetting polyurethane pre-polymer composition as described in U.S. Pat. No. 6,368,533 to Morman, and would be processed according to the teachings of that patent. The second component would consist of a low melting point tackifying compound as used in elastomeric resin blends such as those taught in U.S. 4,789,699 to Kieffer and Wisneski, incorporated herein by reference. Polymer processing and fiber formation would occur at temperatures sufficiently low to avoid significant cross linking of the polyurethane pre-polymer composition until the fibers are no longer in contact with the fiber extrusion apparatus. After the fibers are no longer in contact with the fiber extrusion apparatus they would be subjected to an ultraviolet light energy source to cross-link or cure the thermosetting polyurethane pre-polymer composition. The ratio of the two components would be such that the majority of the fiber would be polyurethane. The resulting meltblown fibers would have the two components in a side-by-side arrangement wherein one side of the fiber comprises primarily thermoset polymer and the other side comprises primarily thermoplastic polymer. The fabric comprising these thermoset-thermoplastic bicomponent fibers would be sufficiently tacky to form interfiber bonds, and furthermore able to form bonds between the fibers and substrates to which they might be attached—for example to form nonwoven elastic laminate materials such as those described in U.S. Pat. No. 4,720,415 Vander Wielen and Taylor and U.S. Pat. No. 4,981,747 to Morman. In addition, the fibers would have enhanced elastic properties derived from the polyurethane resin versus the properties attainable through the use of thermoplastic elastomers.

Although primarily dependent upon the viscosity, the energy activatable thermosetting pre-polymer composition can be partially cross-linked when extruded through a die according to the process of the present invention. For most applications, the total potential amount of crosslinking that may occur in the energy activatable thermosetting pre-polymer composition should be less than about 10% during extrusion. Once exposed to an energy source, crosslinking should occur fairly rapidly. For example, for most extrusion processes, at least 50% of the crosslinking should occur in less than about 10 seconds when the energy activatable thermosetting pre-polymer composition is or has been subjected to the activation energy source.

As described above, polyurethanes are particularly well suited for use in the process of the present invention.

Polyurethanes have great elasticity and strength, have great abrasion resistance, are resistant to solvents and to oxygen aging, and possess excellent shock absorption properties due to their viscoelastic nature. In particular, polyurethanes can have an elongation of over 100%, and particularly over about 175%. Polyurethanes can be made from a pre-polymer composition containing an isocyanate, a polyol, and a curing agent, such as a diamine. The polyol present within the composition can be a polyether or a polyester. Polyesters result in a product generally with better flexibility, while polyethers produce polymers that may be more chemically resistant and hydrolytically stable.

Figure 3:
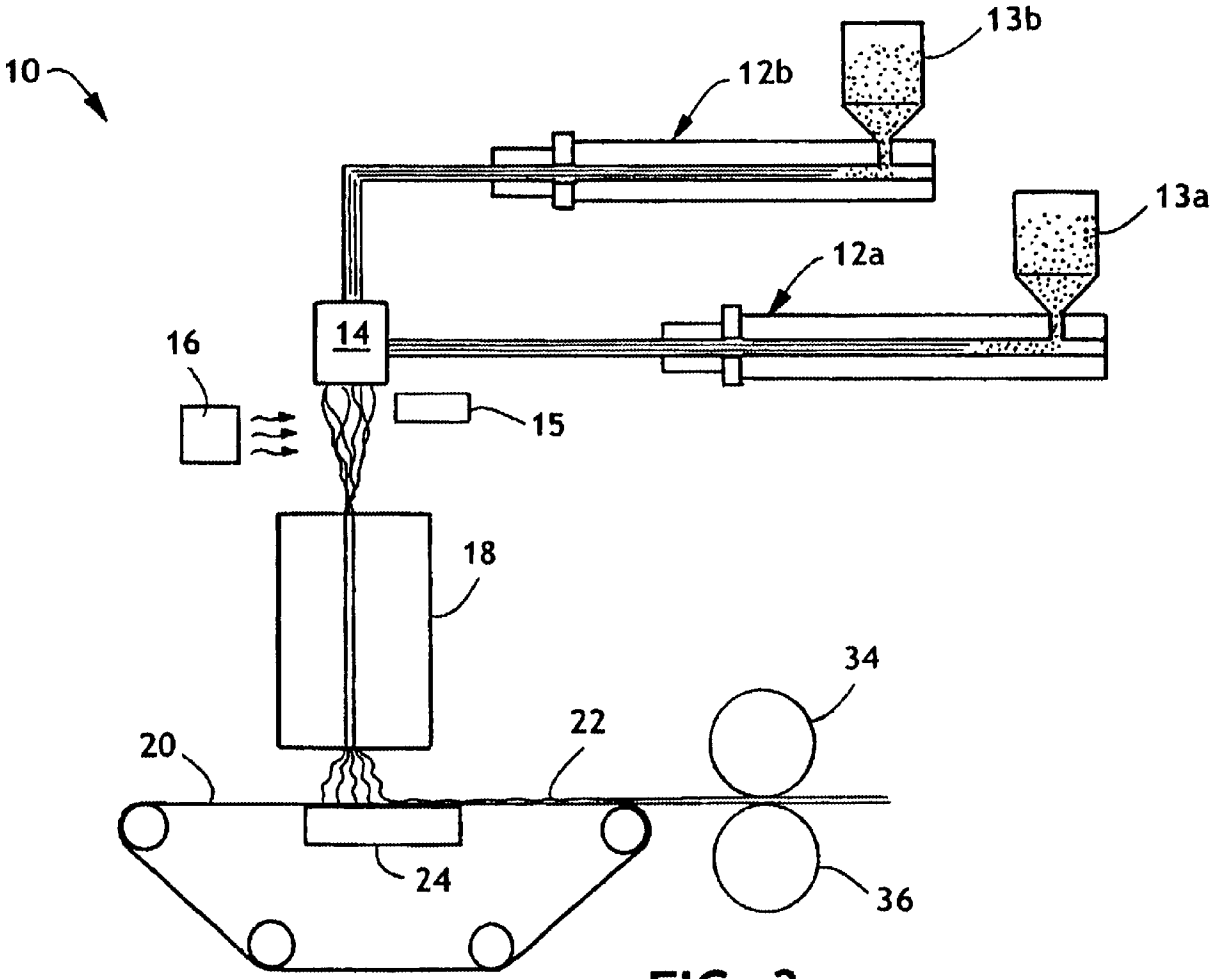
FIG. 3 is another schematic illustration of an exemplary process for producing the multicomponent fibers and multicomponent fiber fabrics of the present invention.

Turning to FIG. 3, there is illustrated another exemplary process for producing the thermoset-thermoplastic multicomponent fibers of the present invention. A process line 10 is arranged as a spunbond process to produce a nonwoven web of multicomponent fibers containing two polymer components, however it should be understood that the present invention encompasses multicomponent fibers, and fabrics therefrom, which are made with more than two components. The process line 10 includes a pair of extruders 12*a* and 12*b* for separately extruding thermoplastic polymer component A and an energy activatable thermosetting pre-polymer composition as component B. Thermoplastic polymer component A is fed into the respective extruder 12*a* from a first hopper 13*a* and the energy activatable thermosetting pre-polymer composition component B is fed into the respective extruder 12*b* from a second hopper 13*b*. Alternatively, the energy activatable thermosetting pre-polymer composition may be injected or pumped into the process line 10 just at the spinneret 14 or at any point prior to extrusion at the spinneret 14 by other means known to the art as for example by use of a cavity transfer mixer (not shown). In the instance where the energy activatable thermosetting pre-polymer composition is injected as described above extruder 12*b* may be omitted from process line 10.

Thermoplastic polymer component A and energy activatable thermosetting pre-polymer composition component B are fed from the extruders 12*a* and 12*b*, respectively, to a spinneret 14. Spinnerets for extruding multicomponent fibers are well known to those of ordinary skill in the art and thus are not described here in detail. Generally described, the spinneret 14 includes a housing containing a spin pack which includes a plurality of plates stacked one on top of the other with a pattern of openings arranged to create flow paths for directing polymer components A and B separately through the spinneret. An exemplary spin pack for producing multicomponent fibers is described in U.S. Pat. No. 5,989,004 to Cook, the entire contents of which are incorporated herein by reference. Alternatively, the apparatus and method for producing a treated fiber described in U.S. Pat. No. 6,350,399 to Cook et al., incorporated herein by reference, may be utilized to produce a sheath and core type fiber wherein a thermoset "sheath" is coated on the outer perimeter of the thermoplastic core.

The spinneret 14 has openings or spinning holes called capillaries arranged in one or more rows. Each of the spinning holes receives predetermined amounts of the component extrudates A and B in a predetermined sectional configuration, forming a downwardly extending strand of the thermoplastic-thermoset multicomponent fiber. The spinneret produces a curtain of the multicomponent fibers. A quench air blower 16 is located adjacent the curtain of fibers extending from the spinneret 14 to quench the thermoplastic polymer composition of the fibers. The quench air can be directed from one side of the fiber curtain as shown in FIG. 3, or may be directed from quench air blowers positioned on both sides (not shown) of the fiber curtain. As used herein, the term "quench" simply means reducing the temperature of the fibers using a medium that is cooler than the fibers such as using, for example, ambient air.

The thermoplastic-thermoset multicomponent fibers are then fed through a pneumatic fiber draw unit or aspirator 18 which provides the drawing force to attenuate the fibers, that is, reduce their diameter, and to impart molecular orientation therein and, thus, to increase the strength properties of the fibers. Pneumatic fiber draw units are known in the art, and an exemplary fiber draw unit suitable for the spunbond process is described in U.S. Pat. No. 3,802,817 to Matsuki et al., incorporated herein by reference. Generally described, the fiber draw unit 18 includes an elongate vertical passage through which the fibers are drawn by drawing aspirating air entering from the sides of and flowing downwardly through the passage.

An endless foraminous forming surface 20 is positioned below the fiber draw unit 18 to receive the drawn thermoplastic-thermoset multicomponent fibers from the outlet opening of the fiber draw unit 18 as a formed web 22 of multicomponent fibers. Alternatively, the drawn fibers exiting the fiber drawing unit 18 can be collected for further processing into fibers or yarns. A vacuum apparatus 24 is positioned below the forming surface 20 to facilitate the proper placement of the fibers.

As stated, the energy activatable thermosetting pre-polymer component will generally include at least one polymer precursor and a curing agent. In order to cure or cross-link the energy activatable thermosetting pre-polymer composition, energy must be supplied to the thermoplastic-thermoset multicomponent fibers at some point in the process after the multicomponent fibers have been extruded from spinneret 14 but before the fibers exit the entire process. As stated, the particular energy type or source selected will depend upon the energy activatable thermosetting pre-polymer and curing agent selected. Generally speaking, available energy sources include heat, ultraviolet radiation, infrared radiation, ultrasonic waves and microwaves. Process line 10 shows energy source 15 located below spinneret 14 to supply cross-linking or curing energy to the multicomponent fiber curtain. It should be noted that selection of the location of energy source will be determined not only by the particular energy activatable thermosetting pre-polymer composition and curing agent chosen but by considerations such as desired properties of the thermoset-thermoplastic multicomponent fibers and/or desired properties of the formed nonwoven web of multicomponent fibers.

For example, where it is desirable that the energy activatable thermosetting pre-polymer composition be subjected to the curing energy source prior to fiber lay-down, energy source 15 may be located directly under spinneret 14 as shown, or may be located just above the fiber draw unit 18, or may be located within the fiber draw unit 18, or just under the fiber draw unit. However, it may be desirable that the multicomponent fibers be subjected to the curing energy after fiber laydown. As an example, where forming surface 20 has a three-dimensional or shaped surface, energy source 15 may desirably be located below or above forming surface 20 such that the multicomponent fibers of formed web 22 are cured while web 22 is laying upon and conforming to the three-dimensional shape of the forming surface, thus helping to "lock in" the three-dimensional shape.

The formed web 22 is then carried on the foraminous surface 20 to calender bonding rollers 34, 36. Although calender bonding is shown in FIG. 3, any nonwoven fabric bonding process can be used to bond the formed web, including calender bonding as mentioned, pattern bonding, flat calender bonding, ultrasonic bonding, through-air bonding, adhesive bonding, and hydroentangling or mechanical needling processes. As mentioned, a pattern bonding process is shown which employs pattern bonding roll pairs 34 and 36 for effecting bond points at limited areas of the web by passing the web through the nip formed by the bonding rolls 34 and 36. One or both of the roll pair have a pattern of land areas and depressions on the surface, which effects the bond points, and either or both may be heated to an appropriate temperature. The temperature of the bonding rolls and the nip pressure are selected so as to effect bonded regions without having undesirable accompanying side effects such as excessive shrinkage, excessive fabric stiffness and web degradation. Although appropriate roll temperatures and nip pressures are generally influenced by parameters such as web speed, web basis weight, fiber characteristics, the thermoplastic polymer selected for component A and the like, the roll temperature desirably is in the range between the softening point and the crystalline melting point of the thermoplastic polymer component which is used in the multicomponent fiber. For example, desirable settings for bonding a fiber web having thermoplastic-thermoset multicomponent fibers having polypropylene as the thermoplastic polymer component are a roll temperature in the range of about 125° C. and about 160° C. and a pin pressure on the fabric in the range of about 200 kg/cm2 and about 3,500 kg/cm2.

Other exemplary bonding processes suitable for bonding the thermoplastic-thermoset multicomponent fiber web include through-air bonding processes. A typical through-air bonding process applies a flow of heated air onto the web to effect inter-fiber bonds, and the bonding process is particularly useful for nonwoven webs containing multicomponent fibers having at least one high melting component and one low melting component such that the low melting component can be heat activated to form inter-fiber bonds while the high melting component retains the physical integrity of the webs. However, in the thermoplastic-thermoset multicomponent fibers of the invention the thermoplastic polymer component represents the above-mentioned low-melting component while the thermoset polymer component itself, being a thermoset, would not melt at all. The heated air is applied to heat the web to a temperature above the softening point of the thermoplastic polymer component of the web but at a temperature below the thermal degradation point of the thermoset polymer component of the fibers. A through-air bonding process does not require any significant compacting pressure and, thus, is highly suitable for producing a lofty bonded fabric.

While not shown here, various additional potential processing and/or finishing steps known in the art such as aperturing, slitting, stretching, treating, or lamination with films or other nonwoven layers, may be performed without departing from the spirit and scope of the invention. Examples of web finishing treatments include electret treatment to induce a permanent electrostatic charge in the web, or antistatic treatments. Another example of web treatment includes treatment to impart wettability or hydrophilicity to a web comprising hydrophobic thermoplastic material. Wettability treatment additives may be incorporated into the polymer melt as an internal treatment, or may be added topically at some point following fiber or web formation. In addition, various processing steps as have been described herein may be altered without departing from the spirit and scope of the invention. As an example, mechanical driven draw rollers as are known in the art may be substituted for the pneumatic drawing and attenuation step described above.

As stated, the components of the multicomponent fibers may comprise, in addition the polymer composition, various additives to impart desirable properties to the multicomponent fibers. As an example, it is often highly desirable to have nonwoven web materials which are flame resistant. However, the thermoplastic polymers typically used for nonwoven webs have poor flame resistance and must have very high levels of flame retardant chemicals such as for example SbO3 added to the thermoplastic polymer melt to achieve flame resistance. Besides being expensive, loading high levels of chemicals for flame resistance into the fiber can deleteriously affect fiber spinning processes. On the other hand, thermoset polymers may be selected which are inherently flame resistant. Using the thermoplastic-thermoset multicomponent fiber of the present invention, it is possible to produce flame resistant multicomponent fibers having a relatively low level of overall loading of flame retardant chemicals. As a specific example, by using a multicomponent fiber of the invention in a sheath and core configuration, where the sheath is the thermoplastic polymer component and the core is the thermoset polymer component, it is possible to reduce the amount of flame retardant chemical by half where the sheath-to-core weight ratio of the fiber is 50:50. Also, since the components need not be present in the multicomponent fiber in equal ratios, one may reduce the amount of flame retardant chemical still further by adjusting the sheath-to-core weight ratio of the multicomponent fiber to reduce the sheath component further, such as for example 40% sheath or 30% sheath or less.

As another embodiment of the present invention the thermoplastic-thermoset multicomponent fiber may utilize the superior elastic characteristics of thermoset elastic polymers such as thermoset polyurethanes. The thermoplastic-thermoset multicomponent fiber may, for example, comprise a thermoset polyurethane core component for powerful elastic properties and an elastic thermoplastic as the sheath component for thermal bondability, such as elastic single-site catalyzed or metallocene catalyzed polyolefin polymers and copolymers as are known in the art. Other suitable thermoplastic elastomers may be used such as, for example the elastic tri- and tetra-block elastic copolymers as are known in the art and readily available on a commercial basis.

As another embodiment of the present invention the thermoplastic-thermoset multicomponent fibers may be formed into a web which is used as a laminate that contains at least one layer of a thermoplastic-thermoset multicomponent fiber web and at least one additional layer of another woven or nonwoven fabric, or a film, or foam. The additional layer for the laminate is selected to impart additional and/or complementary properties, such as liquid absorbency, or liquid barrier and/or microbe barrier properties. The layers of the laminate can be bonded to form a unitary structure by a bonding process known in the art to be suitable for laminate structures, such as thermal, ultrasonic or adhesive bonding processes. An exemplary laminate structure is disclosed in U.S. Pat. No. 4,041,203 to Brock et al., incorporated herein in its entirety by reference, which discloses a pattern bonded laminate of at least one fiber nonwoven web, e.g., spunbond fiber web, and at least one microfiber nonwoven web, e.g., meltblown web. Such a laminate combines the properties of the thermoplastic-thermoset multicomponent fiber web with the breathable barrier properties of the microfiber web. Alternatively, a breathable film can be laminated to the thermoplastic-thermoset multicomponent fiber web to provide a breathable barrier laminate material. As yet another embodiment of the present invention, the thermoplastic-thermoset multicomponent fiber web can be laminated to a non-breathable film to provide a high barrier laminate material. These laminate structures are highly suitable for various uses including various skin-contacting applications, such as protective garments, covers for diapers, adult care products, training pants and sanitary napkins, various drapes, and the like.

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

We claim:

1. A process for making a plurality of multicomponent fiber fibers comprising the steps of:

a) providing a thermosetting pro-polymer component;

b) providing a themoplastlc polymer component;

c) co-extruding said thermosetting pro-polymer component and said thermoplastic polymer component as a plurality of multicomponent fibers wherein said components are arranged in distinct zones across the cross-section of the fibers extending substantially continuously along the length of the fibers;

d) attenuating said multicomponent fibers by subjecting said fibers to a drawing force;

e) subjecting said fibers to energy sufficient to cause the thermosettlng pre-polymer component to crosslink; and f) collecting said plurality of fibers upon a moving surface to form a nonwoven web of multicomponent fibers.

2. The process of claim 1 wherein said energy is selected from the group consisting of heat, ultraviolet radiation, infrared radiation, ultrasonic waves and microwaves.

3. The process of claim 2 wherein said energy is supplied by streams of heated air.

4. The process of claim 1 wherein said components are arranged such that each said component occupies at least a portion of the outer surface of said fibers.

5. The process of claim 1 wherein the step of subjecting the fibers to energy occurs prior to the step of collecting the fibers upon a moving surface.

6. The process of claim 1 wherein the step of attenuating the fibers is carried out using a pneumatic fibers drawing unit.

7. The process of claim 6 wherein the step of subjecting the fibers to energy occurs after the fibers are substantially attenuated but before the fibers enter the pneumatic fibers drawing unit.

8. The process of claim 6 wherein the step of subjecting the fibers to energy occurs while the fibers are passing through the pneumatic fiber drawing unit.

9. The process of claim 1 wherein the step of subjecting the fiberss to energy occurs after the step of collecting the fiberss upon said moving surface.

10. The process of claim 9 wherein the step of collecting said fiberss upon said moving surface is carried out upon a moving surface having a shaped collecting surface.

* * * * *

UNITED STATES PATENT AND TRADEMARK OFFICE

CERTIFICATE OF CORRECTION

PATENT NO. : 6,911,174 B2
APPLICATION NO. : 10/331708
DATED : June 28, 2005
INVENTOR(S) : Creagan It is certified that error appears in the above-identified patent and that said Letters Patent is hereby corrected as shown below:

Column 13, line 26, Claim 1, “fiber fibers” should read --fibers--;
Column 13, line 28, Claim 1, a), “pro-polymer” should read --pre-polymer--;
Column 13, line 30, Claim 1, c), “pro-polymer” should read --pre-polymer--;
Column 14, line 4, Claim 1, e), “thermosettlng” should read --thermosetting--;
Column 14, line 19, Claim 6, “pneumatic fibers” should read --pneumatic fiber--;
Column 14, line 29, Claim 9, “fiberss” should read --fibers--;
Column 14, line 30, Claim 9, “fiberss” should read --fibers--.

Signed and Sealed this

Fifteenth Day of August, 2006

JON W. DUDAS
*Director of the United States Patent and Trademark Office*